US005813479A

United States Patent [19]

Bosma

[11] Patent Number: 5,813,479

[45] Date of Patent: Sep. 29, 1998

[54] TRIGGER MECHANISM FOR IMPACTING DEVICE

[76] Inventor: Marinus A. Bosma, 2234 Marina Park Dr., Fort Myers, Fla. 33905

[21] Appl. No.: 838,453

[22] Filed: Apr. 7, 1997

Related U.S. Application Data

[63] Continuation-in-part of Ser. No. 540,223, Oct. 6, 1995, Pat. No. 5,662,177.

[51] Int. Cl.[6] ..... B25D 17/24

[52] U.S. Cl. ..... 173/202; 173/118; 173/210

[58] Field of Search ..... 173/202, 118, 173/122, 124, 210, 171

[56] References Cited

U.S. PATENT DOCUMENTS

| | | | |
|---|---|---|---|
| 3,358,778 | 12/1967 | Ferwerda | 173/202 |
| 3,358,779 | 12/1967 | Cunningham | 173/202 |
| 4,076,081 | 2/1978 | Schnell | 173/124 |
| 4,785,893 | 11/1988 | Kistner | 173/202 |
| 5,662,177 | 9/1997 | Eftefield et al. | 173/124 |

*Primary Examiner*—Scott A. Smith
*Attorney, Agent, or Firm*—William Weigl

[57] ABSTRACT

A device for breaking concrete and similar frangible materials to reduce it to rubble includes a power plunger and a trigger mechanism mounted within a casing. The casing may be carried on and operated by construction equipment such as a back hoe. The trigger mechanism is operative to release the plunger for allowing it to be fired by spring means or dropped by gravity for a preset distance against the concrete. The power plunger has a latch member affixed thereto and forming one element of the trigger mechanism. The element consists of a concave spherical latching edge portion on its underside. The trigger mechanism also includes a releasable trigger having a convex spherical latching edge portion which mates with the concave portion. The trigger initially catches beneath the latch member, and is then pivoted to release the latch member and allow the power plunger to be fired. The mating spherical latching surfaces provide for a smooth, minimal-wear release of the trigger mechanism. Cocking of the power plunger may be accomplished either mechanically or hydraulically.

12 Claims, 4 Drawing Sheets

TRIGGER MECHANISM FOR IMPACTING DEVICE

This application is a continuation-in-part of my U.S. patent application Ser. No. 08/540,223 filed Oct. 6, 1995, now U.S. Pat. No. 5,662,177, and is also based in part on my U.S. provisional patent application, Ser. No. 60/029,627 filed Oct. 25, 1996.

This invention relates generally to a device for impacting the surface of a frangible material such as concrete in order to demolish and reduce it to rubble, and in particular to a trigger mechanism having essentially spherical latching surfaces.

BACKGROUND OF THE INVENTION

Devices for accomplishing the above-stated objective are known, and are typically mounted on a boom-like member of a back hoe or other relatively heavy duty earth equipment used in the construction industry. Examples of prior art relating to this invention are U. S. Pat. No. 4,785,893 issued to Kistner on Nov. 22, 1988 and U. S. Pat. No. 4.867,253 issued to Eftefield et al on Sept. 19, 1989.

Because of the very severe environment in which such devices are used, primarily when demolishing or breaking concrete roads at the outset of a reconstruction program where abrasive particles and dust are flying in all directions, and because of the tremendous forces generated in concrete destruction, the impacting devices are normally subject to rapid wear, frequent servicing and parts replacement. The bearing surfaces supporting the plunger or plungers of the impacters require lubrication, but the lubricating grease can become a carrier for the grit and dust from the concrete. Grit can carry not only into the bearings, but oftentimes directly into the shielded housing or casing which support the plunger actuating mechanisms and a spring means which may be used for firing the power plunger. Once bearing wear starts, it often progresses rapidly. If a pair of plungers are used, they are then subjected to increased misalignment relative to each other, causing uneven greater and more rapid wear of the internal trigger mechanism as a result. Where a compression spring is used, its loading preparatory to firing the power plunger inherently tends to impart torsion to the power plunger, possibly causing internal scoring and galling of its casing as well as of the trigger mechanism. The more complicated the trigger and latching members are and the greater the number of movable parts they contain, the greater the frequency of parts replacement due to the destructive abrasiveness of the materials from the environment and the tremendous forces to which the operating parts are subjected. Of necessity, the more frequently parts must be replaced, the greater is the need to utilize removable fasteners to facilitate the parts replacement. Nut-and-bolt type fasteners are more likely to break down faster than a weld, for example, from the constant high pounding they take during breaking concrete. Additionally, prior art trigger and latching mechanisms were subjected to severe forces in order to effect release, since the compression spring is preloaded to near its maximum at the time the trigger must go over center against the spring force to release the latch. The added force required to release the trigger and latching mechanism resulted in an increase in the rate of wear of the loaded parts. Once the trigger mechanism is subjected to misalignment, wear ensues rapidly.

The aforementioned prior art systems are designed solely for mechanical trigger cocking and firing operation. While many different types of hydraulically-operable concrete breakers are also known, their hydraulics are used for firing a plunger or chisel against the concrete, and not for cocking the plunger and trigger mechanism as will be described herein.

SUMMARY OF THE INVENTION

A device for breaking concrete and similar frangible materials to reduce it to rubble includes a power plunger and a trigger mechanism mounted within a casing. The casing may be carried on and operated by construction equipment such as a back hoe. The trigger mechanism is operative to release the plunger for allowing it to be fired a preset distance against the concrete. The power plunger has a latch member affixed thereto and forming one element of the trigger mechanism. The element consists of a concave spherical latching edge portion on its underside. The trigger mechanism also includes a releasable trigger having a convex spherical latching edge portion which mates with the concave portion. The trigger initially catches beneath the latch member, and is then pivoted to release the latch member and allow the power plunger to be fired. The mating spherical latching surfaces provide for a smooth release of the trigger mechanism, resulting in reduced wear and tear of the parts compared to conventional over-center trigger mechanisms of the prior art. Cocking of the power plunger may be accomplished either mechanically or hydraulically.

A principal object of the invention is to provide a novel triggering and latching means for a device of the type described.

An ancillary object is to provide such a means which results in reduced wear of the parts, due to accommodation of potential misalignment of the power plunger as wear of its bearings occurs.

Another object is to provide for either mechanical or hydraulic cocking of the power plunger, enabling use of the device with a variety of different types of construction equipment.

A further object of the invention is to eliminate the inherent torsional effect on the power plunger of the coil spring, thereby preventing galling and scoring of the inside of the casing during spring compression.

Another object is to provide relatively large spherical or modified-spherical surface areas on a pair of cooperating latching edges, to accommodate plunger misalignment due to normal wear and tear resulting from operation.

A further object is to provide a trigger and latching mechanism which avoids the necessity of their being made to go over center to further compress an already-loaded coil spring at the time of latch release.

Another object of the invention is to provide a concrete breaker having a unit positioning means which maintains contact with the concrete surface while allowing lateral movement of the unit without hanging up on the edge of a broken piece of concrete.

Further objects and advantages will become apparent from the following description, in which reference is made to the accompanying drawings.

DESCRIPTION OF THE PREFERRED EMBODIMENT

Figure 1:
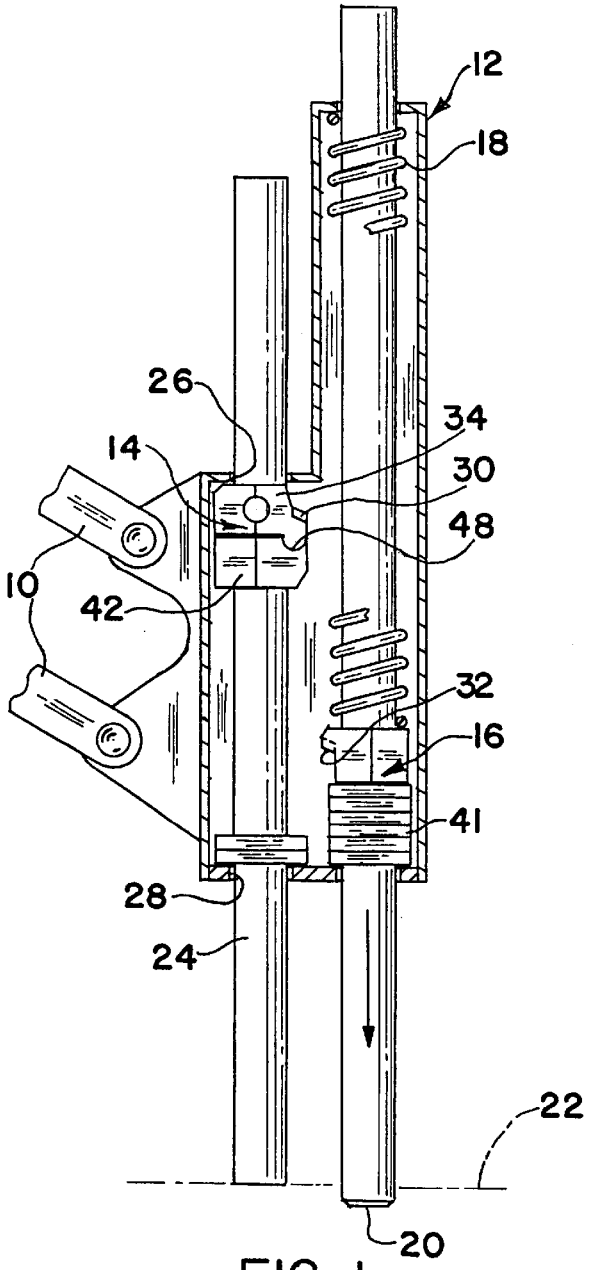
FIGS. 1 through 4 are sequential, fragmentary cross-sectional elevational views of the device mounted on a boom of a construction machine, illustrating the steps in which a power plunger which has just been fired is recocked and refired against the surface to be broken.
Figure 2:
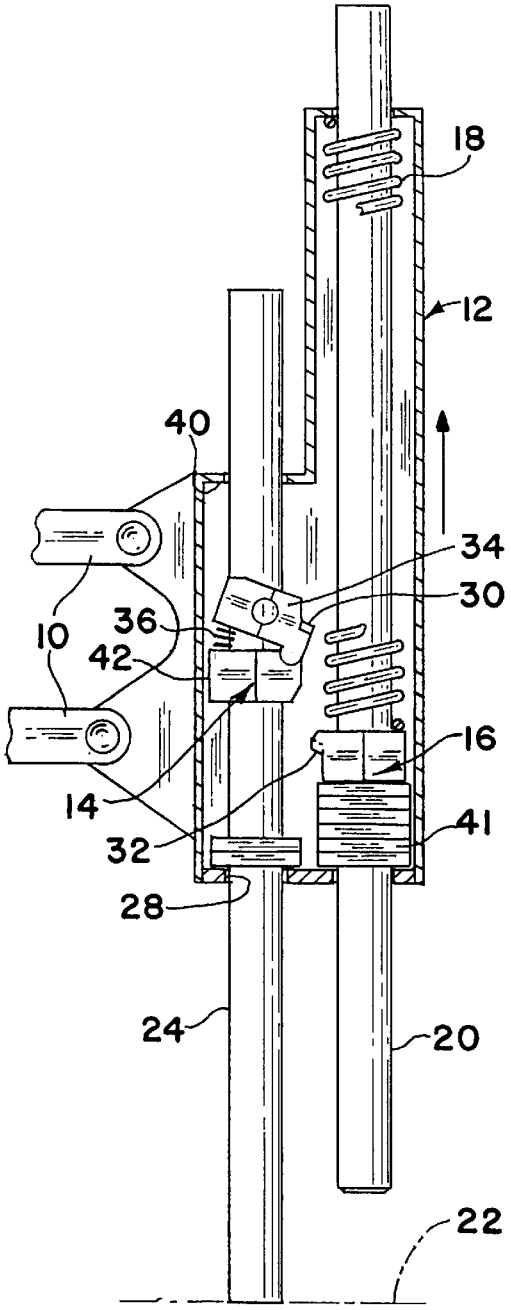
Figure 3:
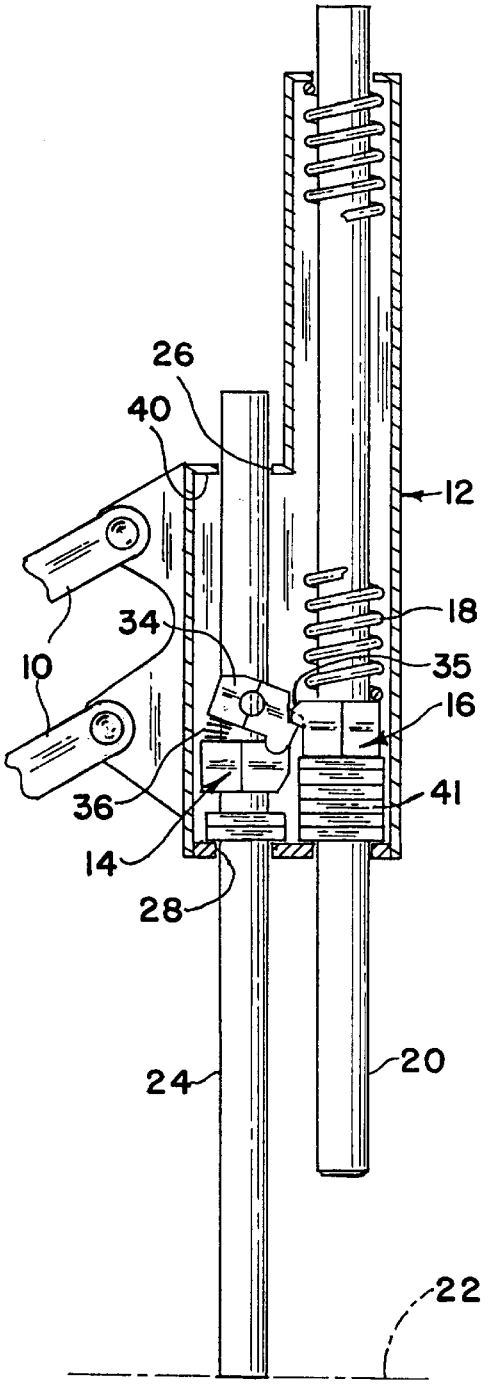

A general description of the manner in which one form if the device functions is disclosed in FIGS. 1 through 4. A parallelogram linkage 10 of a boom-like structure of a back hoe or other piece of construction machinery is shown in FIG. 1, where a casing 12 is located in its lowermost position and the linkage 10 is pointing downwardly. This is a position in which a trigger mechanism 14 has just been actuated to release a latch member 16, allowing sudden expansion of a compression coil spring 18, resulting in firing of a solid steel power plunger 20 toward a surface 22 of concrete or other material to be reduced to rubble. Since the effects of a localized impact blow to concrete are well understood, it will not be described further herein, except to state that after each impact, the process is repeated. The blow can be likened to that of a sledge hammer striking and cracking concrete.

After the blow of FIG. 1 has been delivered, the linkage 10 is raised to commence another impacting cycle. This can be noted from the different angles of the linkage 10 and the changes in vertical height of the casing 12 with respect to the concrete surface 22. The weight of an actuator plunger 24, which is preferably tubular steel, is such that as the linkage 10 moves from the FIG. 1 toward the FIG. 2 and FIG. 3 positions, the plunger 24 slides through its bearings (not shown) mounted in openings 26 and 28, while maintaining contact of its lowermost end with the surface 22. As the casing 12 moves upwardly through the FIG. 2 position to the FIG. 3 position, the trigger mechanism 14 has an upwardly-facing latching edge portion 30 latch beneath a cooperating downwardly-facing latching edge portion 32 of the latch member 16. In order to accomplish this end, a trigger block 34 of the trigger mechanism 14 is pivotally biased by a pair of compression springs 36 to the position of FIGS. 2–4. Just before the trigger block 34 arrives at the latching position of FIG. 3, contact of an edge of the block 34 with a sloping chamfer 35 on the latch member 16 compresses the springs 36 in known fashion to pivot the block 34 counterclockwise until latching edge portion 30 snaps back and is captured beneath and in contact with latching edge portion 32. The casing 12 is then lowered as shown by the direction of arrow 38 in FIG. 4, to load the spring 18 for the next blow of the power plunger 20 to the surface 22. During the lowering, the natural tendency of compression of spring 18 is to apply torsion to latch member 16, but this is resisted in my design by the opposing self-aligning effect of contacting latching edge portions 30 and 32. No such self-aligning was present in similar prior art devices, and galling of the inside of the casing could occur. As a result, the present design requires only a one-eight inch clearance between the latch member 16 and the internal side walls of the casing 12.

Figure 4:
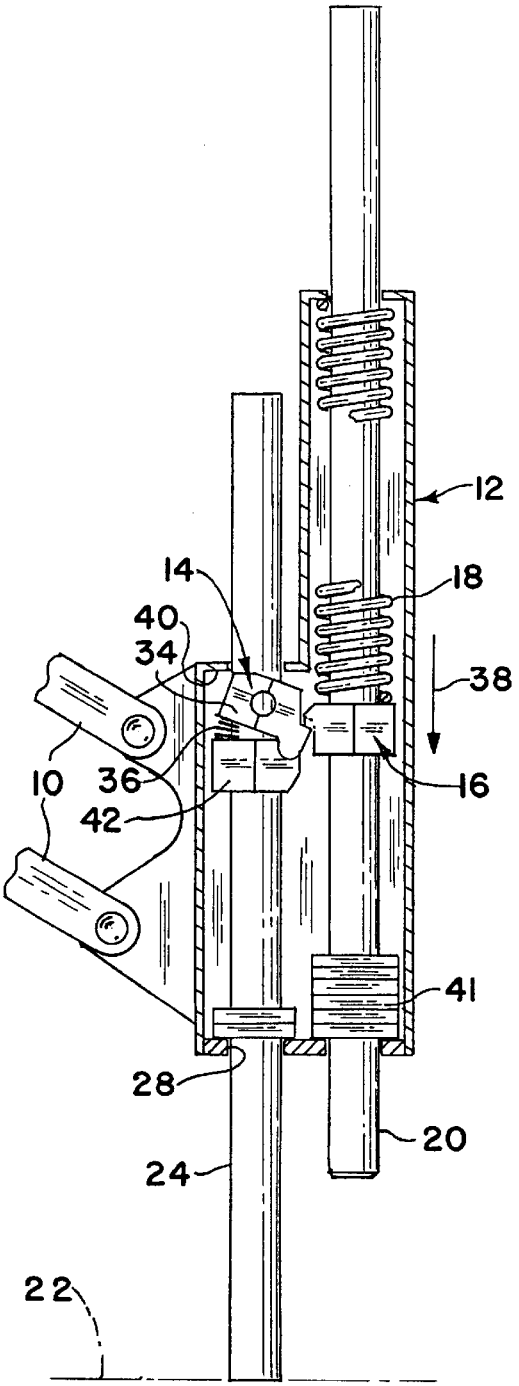

Coil spring 18 is almost compressed to its maximum at approximately the time the descending device reaches the FIG. 4 position. It will be noted that the trigger block 34 is still angled upwardly from compression springs 36. Immediately after this point, the trigger block 34 contacts the upper end of the casing adjacent opening 26. That upper end acts as an operating mechanism 40 to cause the springs 36 to be compressed and the latching edge portion 30 to move out of latching relation with latching edge portion 32. As unlatching occurs, the loaded coil spring 18 takes over and the power plunger 20 impacts the surface 22 to deliver the concrete another blow. The parts all assume their FIG. 1 positions again, and an impacting cycle has been completed. Shock absorbing rubber pads 41 may be utilized to protect the casing in the event the surface 22 does not absorb the entire blow.

What has been described thus far is generally known in the art from the aforesaid '893 and '253 patents. However, those structures are known to have serious wear and servicing problems because of their relative complexity and construction, and because they are required to further compress the already-loaded coil spring 18 as the latch is released. In addition, as wear of the trigger mechanism progressed, torsional loading of the latch member enabled rotation of the power plunger. This rotation eventually resulted in the latch member galling the casing internally.

Figure 5:
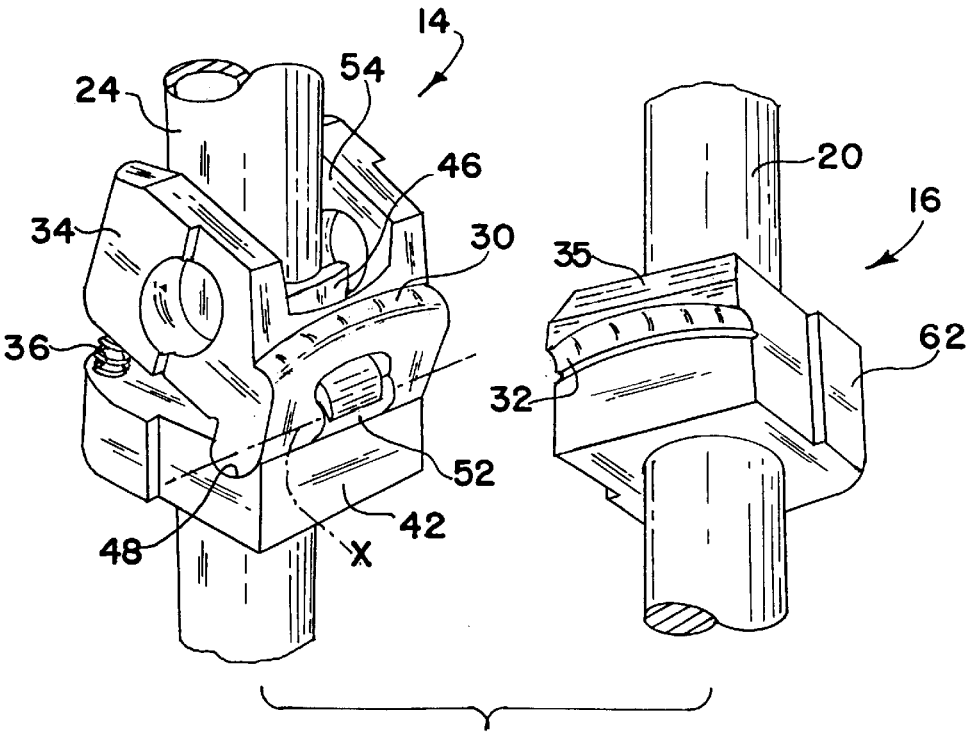
FIG. 5 is a fragmentary exploded isometric view of the triggering mechanism and latch member of the preferred form of the invention.

FIG. 5 is a composite isometric view of the cooperating trigger mechanism 14 and latch member 16. The mechanism 14 includes a solid steel trigger-journaling block 42 which is preferably welded to the actuator plunger 24. For ease of manufacture as well as simplicity, all of the blocks of this invention are preferably made from castings, enabling all complex surfaces to be computer-generated in the mold patterns themselves, rather than machine them separately on the individual parts. Atop the block 42 is the trigger block 34 which is retained in contact therewith by a retaining member 46. The trigger-journaling block 42 is provided with a semi-cylindrical recess 48 and the lower end of the retainer member 46 is similarly recessed as at 50. Together, the recesses 48 and 50 capture a cylindrical journal 52, making the block 34 pivotable about the axes of the journal 52 and recesses 48 and 50. The trigger block 34 is normally urged clockwise and angularly upwardly toward the right as viewed in FIG. 6 as the result of bias of the springs 36. In the instance where the actuator plunger is cylindrical as shown, rightward movement is limited by one end of the elliptical shape of an elongated opening 54 which causes the left end 56 of the opening 54 to contact the actuator plunger 24. The retaining member 46 is preferably provided with a concave surface adjacent the plunger 24 to facilitate good welding contact therewith. In effect, the trigger block 34 is trapped to follow the trigger-journaling block 42 at all times.

Figure 6:
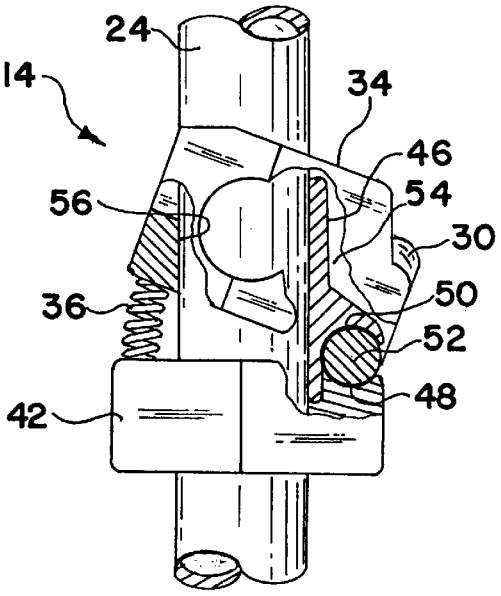
FIG. 6 is an elevational view of the triggering mechanism with parts broken away for clarity.
Figure 7:
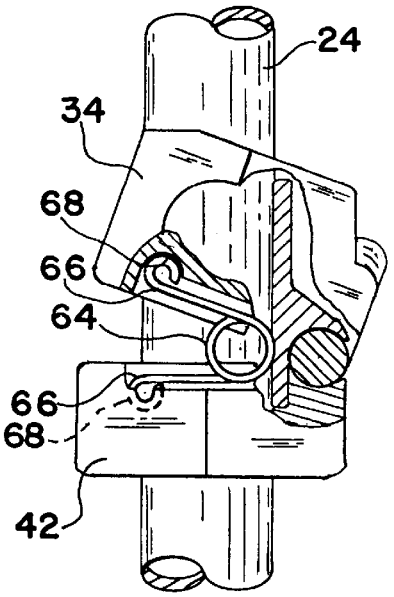
FIG. 7 is a view similar to FIG. 6 showing a modified spring arrangement between the members of the triggering mechanism.

FIG. 7 is a view similar to that of FIG. 6 illustrating a modification in which a pair of torsion springs 64 at opposite sides of the blocks 34 and 42 replace the compression springs 36 of the FIG. 6 version. The springs 64 have their ends 66 formed to be captured in pockets 68 cast in each side of each block 34 and 42. The torsion springs are easier to install and to replace if necessary, and are less subject to wear than the compression springs 36.

As shown best in FIG. 5., the trigger block 34 has the convex latching edge portion 30 formed about a radius on the order of eight inches. However, the center or axis (represented by the dot-dash line "x") about which the trigger block 34 pivots, is only two and one-half inches at the opposite sides of block 34 and is three and one-eight of an inch at the center or high point of latching edge portion 30. In effect, axis x represents a chordal line across the larger eight-inch radius which forms the curvature of the edge portion 30. The portion 30 may thus be said to have a modified-spherical configuration with its largest radius along axis x being in the middle, tapering toward a smaller radius at each of its ends. If the axis x were at the eight inch center, the surface of latching edge portion 30 would be truly spherical. A similar mating concave modified-spherical latching edge portion 32 is provided on the underside of a latch block 62. Block 62 is the sole element of the latch member 16. The latch block 62 is cast solid steel to add maximum weight to the power plunger 20 and is preferably welded to the power plunger 20 to minimize any impacting effects on the structure, such as might occur if removable fasteners were to be used. By producing latch block 62 from a casting, the modified-spherical configuration of edge portion 32 can be controlled in the mold pattern and need not be specially machined on each block produced.

It can be seen that any tendency toward plunger torsional and wear misalignment will be compensated for because of the shape of the latching edge portions 30 and 32, independently of whether the plungers are misaligned and out of parallel in any specific direction. The latching edge portions thus effectively become a universal joint which is lubricated with an appropriate grease. Additionally, the modified-spherical latching edges make for a freer release of the latching device, since its tendency will be for the surfaces to smoothly slide apart during unlatching without any compression of spring 18, rather than pass over a sharp edge, which requires further compression of spring 18 at a time when it is already loaded to near-maximum compression. It can be noted, for example, that there is essentially point contact of the latching edges in the aforementioned '253 and '893 patents, whereas the large spherical surface areas of the edge portions 30 and 32 provide for reduced and more even surface wear. Even though dirt and dust may eventually enter the casing 12 and come in contact with the components described herein, those components will be less subject to wear because of their rugged construction, simplicity and large latching edge area. Closable access openings (not shown) may be provided in the casing to enable the various blocks to be cleaned and/or lubricated, as required.

The device illustrated in FIGS. 1–4 is quite well adapted for use with a back hoe or another heavy duty piece of construction equipment capable of generating the tremendous downward force necessary to cause the casing 12 to compress spring 18 against the trigger mechanism 14 as the casing descends and is resisted by the actuator plunger 24 abutting the concrete surface.

Figure 8:
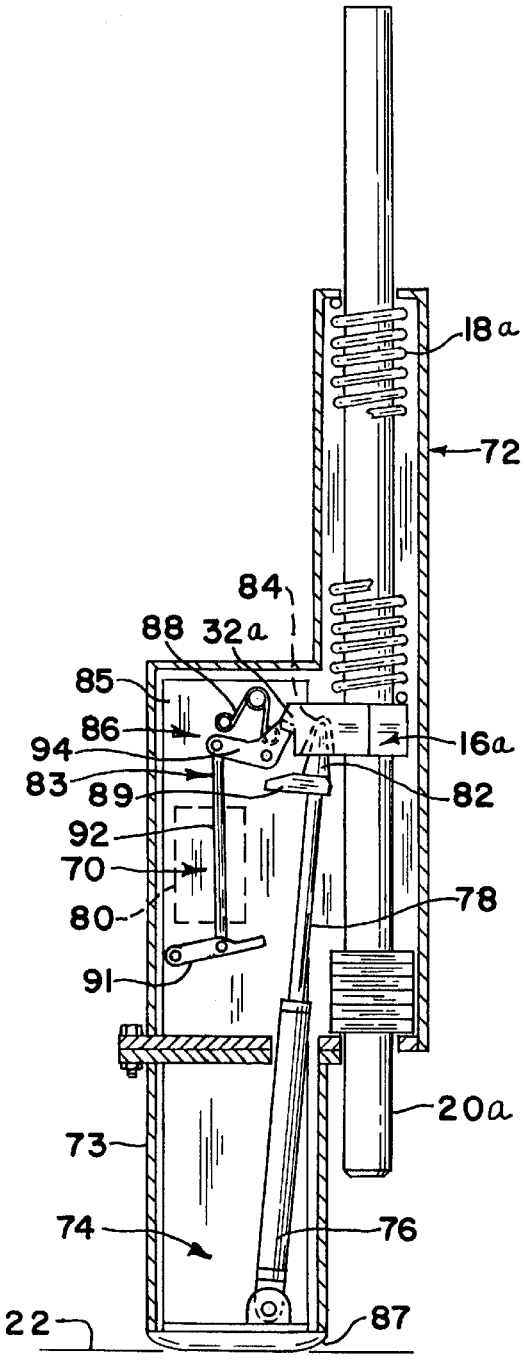
FIG. 8 is a cross-sectional elevational view of an alternative form of concrete breaker illustrating a hydraulically-operated means for cocking the power plunger with a structurally-modified version of trigger mechanism, the various operating elements being illustrated with the power plunger cocked and ready to fire.

In order to enable the unique spherical triggering mechanism to also be used with lighter-duty construction equipment such as the very well known Bobcat skid-steer loader manufactured by the Melroe Company of Fargo, N. Dak., I provide a modified cocking mechanism 70 illustrated in FIGS. 8 and 9. A skid-steer loader turns about essentially like an armored tank and is quite suitable to operate the version of my invention shown in FIGS. 8 and 9 without having to raise and lower a fixed level casing 72 that is maintained above the concrete surface 22 by a depending foot 74 carried by the casing. This foot, unlike the actuator plunger 24, does not function as part of the operating mechanism, but merely determines or gauges the length of stroke of a power plunger 20*a* to the concrete. The foot has a shoe 87 which provides an important feature by virtue of its being rounded or beveled wear pad at its bottom, enabling it to be freely slid around on the concrete surface 22 without hanging up where the concrete was already broken or has cracked. Such a shoe serves equally well on the bottom of the actuator plunger 24 of the version of my invention shown in FIGS. 1–4.

By eliminating the function of the actuator plunger 24 of the device of FIGS. 1–4 in the embodiment of FIGS. 1–4, the construction machine need not be one which presses the casing 72 against the surface 22 to cock the spring. Also, this version can thus be used as a drop-hammer without even needing or cocking any kind of spring such as 18*a*. In such instance, the weight of the power plunger 20*a* and gravity provide the energy to break the concrete. The latch member 16*a* can be raised through operation of a conventional hydraulic cylinder 76 and piston rod 78 under control of the machine operator through appropriate valving (not shown) contained within a box 80 shown simply in dotted lines within the casing 72. The distal end of rod 78 has a hardened steel conical nosepiece 82 which freely enters a corresponding cavity or pocket 84 in the underside of a latch member 16*a*. To accommodate pocket 84, latch member 16*a* has its leftward end extending further outwardly than the comparable latch member 16 of the earlier-described embodiment. The latching edge portion 32*a* therefore also extends further outwardly from the axis of the power plunger 20*a*.

The hydraulic cylinder 76, the box 80 with its valves and hydraulic hoses and a trigger-operating mechanism 83 are mounted on vertical plate 85 which forms a primary structural member for the foot 74 and constitutes a sub-assembly therewith. Below the casing 72, a housing 73 is fastened about the lower end of the plate 85. The housing 73 surrounds and protects the hydraulic cylinder and trigger-operating mechanism 83 from flying debris and dust. The shoe 87 and housing 73 gauge the distance of the casing 72 above the concrete surface 22, and since the skid-steer loader is easily operable to merely slide the unit from one location where concrete has been broken to an adjacent location where it needs to be broken, the rounded edges of the shoe 87 prevent the device from hanging up when contacting an edge of raised, cracked concrete.

Figure 9:
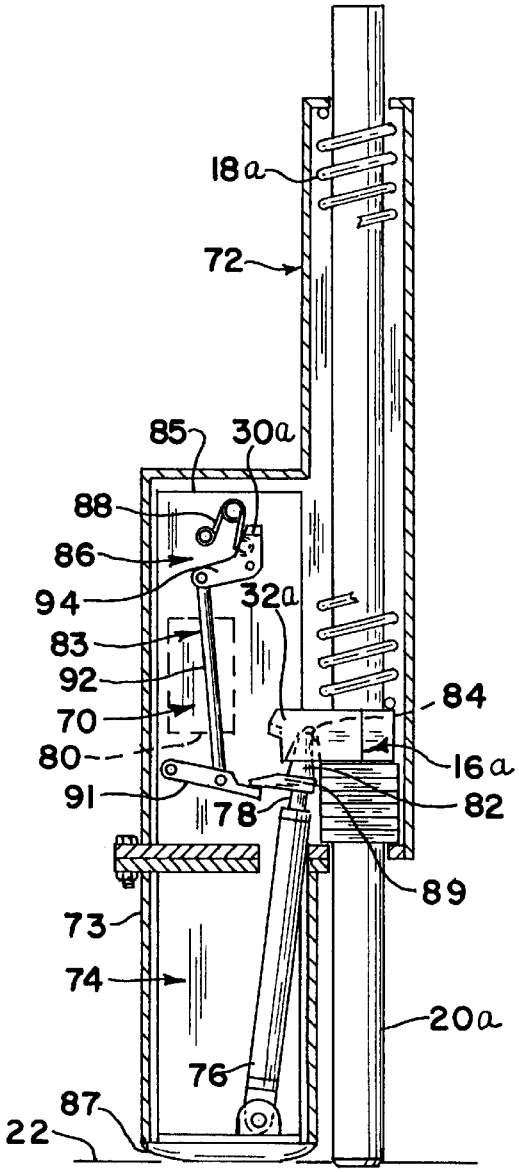
FIG. 9 is a view similar to that of FIG. 8, with the operating elements in their positions after the power plunger has been fired and is in position to commence another cycle of operation.

To cock the latch member 16*a*, the rod 78 is initially retracted within cylinder 76 and is in the position shown in FIG. 9. The nosepiece 82 is ready to move the latch member 16*a* to the FIG. 8 position. The cylinder 76 and piston rod 78 lift the latch member 16*a* until it is latched by a spherical latching edge portion 30*a* of a pivotal trigger 86. Trigger 86 is biased clockwise by a torsion spring 88 like that of FIG. 8 against a stop means (not shown) corresponding to its position shown in FIG. 8. Spring 88 moves trigger 86 as soon as an abutment 89 connected to the nosepiece 82 moves up and out of engagement with the distal end of a pivotal lever 91. The lever 91 is connected to the trigger 86 by means of a link 92 and a pivotal lever 94. The lever 94 and trigger may be part of a bellcrank mechanism journaled on the plate 85. When reaching the FIG. 8 position, a sloping chamfer comparable to chamfer 35 in FIG. 5 causes the spring 88 to increase its torsion (since the left end of the spring is anchored to a pin in the plate 85), snapping the latching edge portion 30*a* beneath the latching edge portion 32*a* as soon as the latch member 16*a* passes above the upper end of the trigger 86.

When the rod 78 is fully extended and the latch member 16*a* latched in its upper or cocked position, the cylinder 76 is controlled by the machine operator to quickly retract the nosepiece 82 to its lower position shown in FIG. 9. When the nosepiece reaches full retraction, the abutment 89 contacts the end of lever 91, pivoting trigger 86 counter-clockwise through link 92 and lever 94. This releases latch member 16*a* and causes spring 18*a* to fire the plunger 20*a* against the concrete surface 22. All of this is done after the operator has repositioned the unit laterally to fire the plunger against an adjacent unbroken section of concrete.

Various changes may be made in the details of construction without departing from the spirit and scope of the claims. While I have illustrated the power plunger as having its energy supplied by a coil spring, other kinds of springs may also be used, or, as noted earlier, the energy can also be generated by gravity as in the case of a drop hammer. Drop hammer use with my invention is feasible, even though it requires the addition of substantial weight to the power plunger as a substitute for the spring 18 or 18*a*.

Having described my invention, I claim:

1. A device for impacting the surface of a frangible material with a sudden, concentrated high force in order to demolish said material, said device including an elongated casing; an elongated power plunger in said casing, said power plunger being reciprocable lengthwise of said casing; guiding means in said casing maintaining said power plunger for lengthwise movement; an actuator means in closely-spaced lateral operating relationship to said power plunger; a releasable latch member affixed to said power plunger between its ends within said casing; said actuator means including a trigger mechanism for engaging and latching with said latch member and for releasing said latch member to enable impacting movement of said power plunger toward said surface upon release of said latch member by said trigger mechanism; and means for operating said trigger mechanism to release said latch member; said trigger mechanism including a pivotally-supported trigger, means for pivoting said trigger and spring means biasing said trigger toward latching engagement with said latch member; the improvement comprising:

said trigger having an upwardly-facing convex, essentially spherical latching edge portion adjacent said pivoting means and facing said latch member in interfering relationship therewith; and, said latch member including a downwardly-facing concave, essentially spherical edge portion facing and corresponding essentially to the convex spherical portion of said trigger, said spherical edge portions being adapted to interfere and latchingly engage and said trigger being adapted to pivot to release said trigger edge portion from interfering contact with said latch member edge portion and thereby enable said power plunger to impact said material.

2. The device according to claim 1 including means for positioning the casing a predetermined distance above the material surface at the time said trigger releases said latch member, in order to predetermine the length of stroke of said power plunger toward said surface.

3. The device according to claim 2 wherein said positioning means comprises a member having a shoe in contact with said surface at least at the time said power plunger is released to impact said surface.

4. The device according to claim 3 wherein said shoe has a bottom surface having edges constructed to ride over a raised edge of broken concrete as the device is moved laterally from one position to another.

5. The device according to claim 4 wherein said shoe edges are essentially rounded.

6. The device according to claim 1 wherein said trigger comprises a portion of a cast solid trigger block.

7. The device according to claim 1 wherein said trigger comprises a pivotal member located at a fixed height within said casing.

8. A device for demolishing the surface of a frangible material with a sudden, concentrated high impact force, said device including:

a casing elongated in a direction extending generally perpendicular to the surface to be demolished;

an elongated power plunger in said casing, said plunger being reciprocable in said casing and having a working end extending outwardly through an opening in said casing;

an actuating means for physically moving said power plunger inwardly away from said opening toward a cocked position;

means for guiding reciprocable lengthwise movement of said power plunger;

a latch member within said casing and affixed to said power plunger between the ends thereof;

power means associated with said power plunger, said power means being loadable against an impacting movement direction for enabling said plunger to be driven toward the material upon release of said latch member;

a fixed-position trigger mechanism for latching said latch member in said cocked position;

means for positioning the casing to predetermine the length of stroke between the working end of said power plunger and the material surface;

means for controlling said actuating means to move said plunger from a first position where its working end is in contact with said surface to a second position corresponding to said cocked position, said latch member being automatically latched by said trigger mechanism upon reaching said cocked position;

said actuating means being operable after the latch member has been latched to return said actuating means to its first position; and means for operating said trigger mechanism to release said latch member upon return of said actuating means to its first position.

9. The invention of claim 8 wherein said power means comprises a loadable spring.

10. The invention of claim 8 wherein said actuating means comprises a hydraulic cylinder having a piston and a rod with a free end having a nosepiece for engaging said latch member from a side opposing the impacting movement direction of said power plunger, and said latch member has a recess for receiving said nosepiece when said actuating means is operated from its first to its second position under hydraulic pressure.

11. The device according to claim 8 wherein said actuating means includes a trigger-operating linkage responsive to return of said nosepiece to said second position.

12. The invention of claim 8 wherein said trigger mechanism includes a convex spherical latching edge portion and said latch member includes a corresponding concave spherical latching edge portion, said spherical latching edge portions being arranged to essentially avoid increased loading of said power means as said latch member is unlatched.

* * * * *